US010886634B2

(12) United States Patent
Zhao et al.

(10) Patent No.: US 10,886,634 B2
(45) Date of Patent: Jan. 5, 2021

(54) FILTER FEEDING NETWORK AND BASE STATION ANTENNA

(71) Applicant: TONGYU COMMUNICATION INC., Guangdong (CN)

(72) Inventors: Wei Zhao, Zhongshan (CN); Zhuofeng Gao, Zhongshan (CN); Xiangxi Yao, Zhongshan (CN); Wenlan Wang, Zhongshan (CN); Mulin Liu, Zhongshan (CN); Samb Doudou, Zhongshan (CN); Qingchen Chu, Zhongshan (CN); Bin Wang, Zhongshan (CN)

(73) Assignee: TONGYU COMMUNICATION INC., Zhongshan (CN)

( * ) Notice: Subject to any disclaimer, the term of this patent is extended or adjusted under 35 U.S.C. 154(b) by 5 days.

(21) Appl. No.: 16/093,346

(22) PCT Filed: Nov. 11, 2016

(86) PCT No.: PCT/CN2016/105460
§ 371 (c)(1),
(2) Date: Oct. 12, 2018

(87) PCT Pub. No.: WO2018/028066
PCT Pub. Date: Feb. 15, 2018

(65) Prior Publication Data

US 2019/0207325 A1 Jul. 4, 2019

(30) Foreign Application Priority Data

Aug. 9, 2016 (WO) ..... PCT/CN2016/094132

(51) Int. Cl.
*H01Q 23/00* (2006.01)
*H01Q 1/24* (2006.01)
(Continued)

(52) U.S. Cl.
CPC ..... *H01Q 23/00* (2013.01); *H01Q 1/246* (2013.01); *H01Q 21/0075* (2013.01); *H01Q 21/24* (2013.01)

(58) Field of Classification Search
CPC .... H01Q 23/00; H01Q 1/246; H01Q 21/0075; H01Q 21/24; H01P 1/20381; H01P 1/2039
See application file for complete search history.

(56) References Cited

U.S. PATENT DOCUMENTS

2003/0197578 A1* 10/2003 Shibahara ..... H03H 7/01 333/193
2009/0046029 A1* 2/2009 Nagai ..... H01Q 21/06 343/850

(Continued)

FOREIGN PATENT DOCUMENTS

CN 101621337 A 1/2010
CN 201812911 U 4/2011
CN 204732538 U 10/2015

OTHER PUBLICATIONS

Apr. 26, 2017 International Search Report issued in International Patent Application No. PCT/CN2016/105460.

*Primary Examiner* — Dimary S Lopez Cruz
*Assistant Examiner* — Michael M Bouizza
(74) *Attorney, Agent, or Firm* — Oliff PLC

(57) ABSTRACT

A filter feeding network, including a dielectric substrate, where a surface of the dielectric substrate's one side is provided a microstrip line, and a surface of the dielectric substrate's other side is provided with a metal ground; the microstrip line includes first and second power division circuits, and first and second filter circuits; an input and output end of the first filter circuit are respectively connected to the first power division circuit's input and output end correspondingly, the second filter circuit's input and output (Continued)

end are respectively connected to the second power division circuit's input and output end correspondingly, and the input end of the first filter circuit and second filter circuit are in conduction with the metal ground; and first and second power division circuit's output end feeds at least two array antenna units for −45° polarization and +45° polarization respectively.

13 Claims, 5 Drawing Sheets

(51) Int. Cl.
*H01Q 21/00* (2006.01)
*H01Q 21/24* (2006.01)

(56) References Cited

U.S. PATENT DOCUMENTS

2012/0169561 A1 7/2012 Bin Basri et al.
2015/0381229 A1* 12/2015 Tzanidis ..... H01Q 23/00
455/73

* cited by examiner

FILTER FEEDING NETWORK AND BASE STATION ANTENNA

BACKGROUND

Technical Field

The present invention relates to the field of mobile communications base station technologies, and in particular, to a filter feeding network and a base station antenna.

Related Art

A distributed base station antenna is a passive antenna, and a remote radio unit (RRU) is connected to the antenna by using a cable. The RRU includes passive modules and active modules such as a duplexer, a transmission/reception filter, a low noise amplifier, a power amplifier, a multimode multiband RF module, and a digital intermediate frequency.

In a development trend of 4.5G and 5G mobile base stations, large-scale MIMO active antennas are used. The active antenna organically combines an entire RRU and the antenna, that is, the RRU uses a large quantity of distributed radio frequency chips and the distributed radio frequency chips are integrated into the antenna. In terms of performance, a conventional base station has a fixed downtilt angle, but an active antenna base station may implement flexible 3D MIMO beamforming, implement different downtilt angles of different users and refined network optimization, improve system capacity, and increase a coverage range. In terms of a structure, an RRU of a distributed base station has a relatively large volume and a large weight, and is installed abutting a back portion of the antenna. However, the large-scale MIMO active antenna is highly integrated, has a small size, and can be easily installed and maintained.

As one of the passive modules in the RRU, the transmission/reception filter has functions of avoiding interference of a neighboring channel and improving communication capacity and a signal to noise ratio of a channel. Currently, a filter used by the RRU mainly includes a coaxial filter or an air cavity filter. A filter of such a type has a relatively large size and a relatively large weight, and it is difficult for the filter to implement integrated design with an antenna.

Technical Problem

To resolve the foregoing technical problem, the present invention provides a filter feeding network and a base station antenna. The filter feeding network is highly integrated, has a small weight and a small volume, and is suitable for large-scale production.

SUMMARY

To resolve the foregoing technical problem, the present invention provides a filter feeding network, including a dielectric substrate, where a surface of one side of the dielectric substrate is provided with a microstrip line, and a surface of the other side of the dielectric substrate is provided with a metal ground; the microstrip line includes first and second power division circuits, and first and second filter circuits; an input end and an output end of the first filter circuit are respectively connected to an input end and an output end of the first power division circuit correspondingly, an input end and an output end of the second filter circuit are respectively connected to an input end and an output end of the second power division circuit correspondingly, and the input end of the first filter circuit and the input end of the second filter circuit are in conduction with the metal ground; and the output end of the first power division circuit feeds at least two array antenna units for −45° polarization, and the output end of the second power division circuit feeds at least two array antenna units for +45° polarization.

Further, the first filter circuit includes a first low-pass filter and a first band-pass filter, and the second filter circuit includes a second low-pass filter and a second band-pass filter; an output end of the first band-pass filter is connected to an input end of the first low-pass filter, an input end of the first band-pass filter is connected to the input end of the first power division circuit, and an output end of the first low-pass filter is connected to the output end of the first power division circuit; and an output end of the second band-pass filter is connected to an input end of the second low-pass filter, an input end of the second band-pass filter is connected to the input end of the second power division circuit, and an output end of the second low-pass filter is connected to the output end of the second power division circuit.

Further, both the first low-pass filter and the second low-pass filter are stepped impedance microstrip low-pass filters.

Further, both the first low-pass filter and the second low-pass filter are seventh-order stepped impedance microstrip low-pass filters.

Further, the first band-pass filter and the second band-pass filter are each formed by two nested microstrips that have hexagonal openings and that are connected at opening ends.

Further, one opening end of the hexagonal openings in the first band-pass filter is connected to the input end of the first power division circuit by using an impedance transformation segment, and the other opening end is connected to the input end of the first low-pass filter by using another impedance transformation segment; and one opening end of the hexagonal openings in the second band-pass filter is connected to the input end of the second power division circuit by using an impedance transformation segment, and the other opening end is connected to the input end of the second low-pass filter by using another impedance transformation segment.

Further, cut-off frequencies of the first low-pass filter and the second low-pass filter are 3.5 GHz.

Further, passband central frequencies of the first band-pass filter and the second band-pass filter are both 2.6 GHz.

Further, a dielectric constant of the dielectric substrate ranges from 2.2 to 10.2, and the thickness of the dielectric substrate ranges from 0.254 mm to 1.016 mm.

Further, the input end of the first filter circuit is connected to the metal ground by a metalized via, and the input end of the second filter circuit is connected to the metal ground by another metalized via.

Further, the first power division circuit and the second power division circuit are each formed by a one-to-two power splitter; or the first power division circuit and the second power division circuit are each formed by multiple cascaded power splitters.

To resolve the foregoing technical problem, the present invention further provides a base station antenna, including the filter feeding network according to any of the foregoing embodiment.

Further, the base station antenna is a base station antenna using a MIMO system.

Beneficial Effects of the Present Invention

Beneficial Effects

The filter feeding network in the present invention has the following beneficial effects.

A microstrip filter is used to replace an RRU cavity filter, and the microstrip filter is integrated with a microstrip power divider, thereby achieving a filter feeding network having a filtering function, simplifying a radio frequency unit structure, and improving system integration. The filter feeding network is highly integrated, has a small weight and a small volume, and is suitable for large-scale production.

Additionally, a microstrip low-pass filter replaces a metal-rod shaped low-pass filter in a cavity filter to filter a high-order harmonic wave of a band-pass filter. In addition, the microstrip low-pass filter and a microstrip band-pass filter are connected in series and are integrated with the microstrip power divider to achieve the filter feeding network having the filtering function. This can lower a requirement on outband suppression of the cavity filter, and reduce the volume and weight of the filter.

DETAILED DESCRIPTION

The following describes the present invention in detail with reference to accompanying drawings and implementations.

Figure 1:
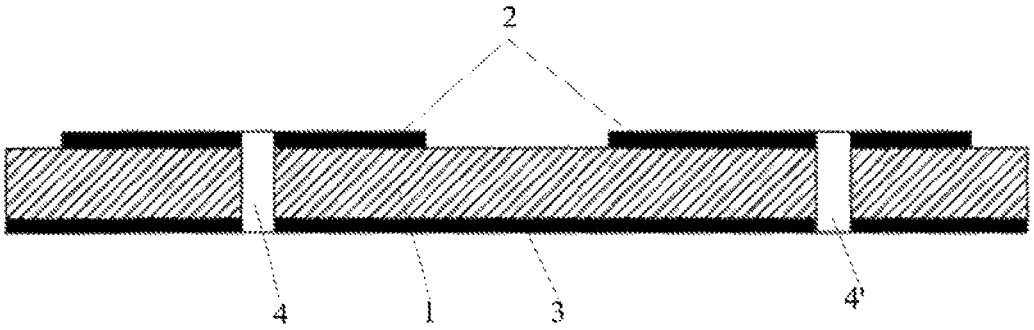
FIG. 1 is a schematic sectional structural diagram of an embodiment of a filter feeding network according to the present invention.

Referring to FIG. 1, the present invention provides a filter feeding network. The filter feeding network includes a first dielectric substrate 1, where a surface of one side of the first dielectric substrate 1 is provided with a microstrip line 2, and a surface of the other side of the first dielectric substrate 1 is provided with a metal ground 3.

The microstrip line 2 includes a first power division circuit 21 and a second power division circuit 21' that have a same structure, and a first filter circuit 220 and a second filter circuit 220' that have a same structure. An input end of the first filter circuit 220 is connected to an input end 211 of the first power division circuit 21, and an output end of the first filter circuit 220 is connected to an output end 212 of the first power division circuit 21. An input end of the second filter circuit 220' is connected to an input end 211' of the second power division circuit 21', and an output end of the second filter circuit 220' is connected to an output end 212' of the second power division circuit 21'. The input end of the first filter circuit 220 and the input end of the second filter circuit 220' are in conduction with the metal ground 3. Preferably, the input end of the first filter circuit 220 is connected to the metal ground 3 by using a first metalized via 4, and the input end of the second filter circuit 220' is connected to the metal ground 3 by using a second metalized via 4'.

Figure 2:
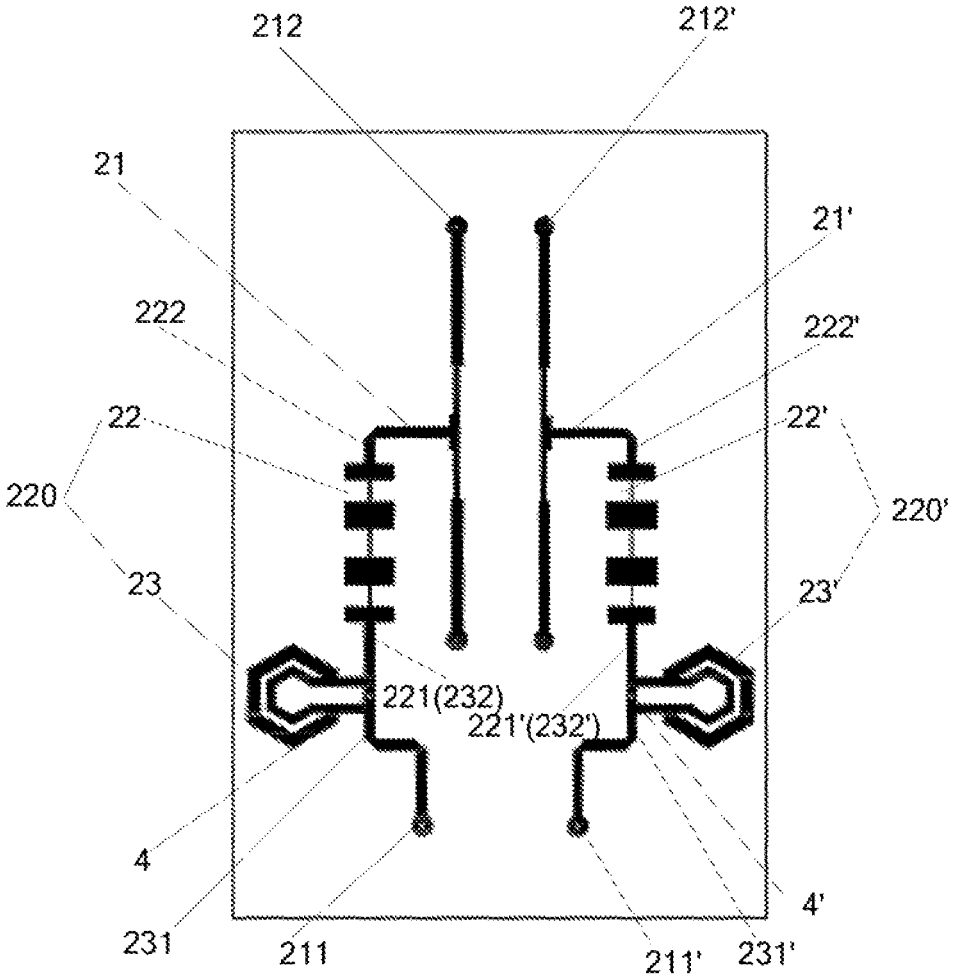
FIG. 2 is a schematic structural diagram of an embodiment of a microstrip line in the filter feeding network shown in FIG. 1.

In an application embodiment, referring to FIG. 2, the first filter circuit 220 includes a first low-pass filter 22 and a first band-pass filter 23 that are set in series. The second filter circuit 220' includes a second low-pass filter 22' and a second band-pass filter 23' that are set in series. The first low-pass filter 22 and the second low-pass filter 22' have a same structure, and the first band-pass filter 23 and the second band-pass filter 23' also have a same structure.

Specifically, an output end 232 of the first band-pass filter 23 may be connected to an input end 221 of the first low-pass filter 22 by using a microstrip, an input end 231 of the first band-pass filter 23 may be connected to the input end 211 of the first power division circuit 21 by using the microstrip, and an output end 222 of the first low-pass filter 22 may be connected to the output end 212 of the first power division circuit 21 by using the microstrip. An output end 232' of the second band-pass filter 23' may be connected to an input end 221' of the second low-pass filter 22' by using the microstrip, an input end 231' of the second band-pass filter 23' may be connected to the input end 211' of the second power division circuit 21' by using the microstrip, and an output end 222' of the second low-pass filter 22' may be connected to the output end 212' of the second power division circuit 21' by using the microstrip.

Figure 3:
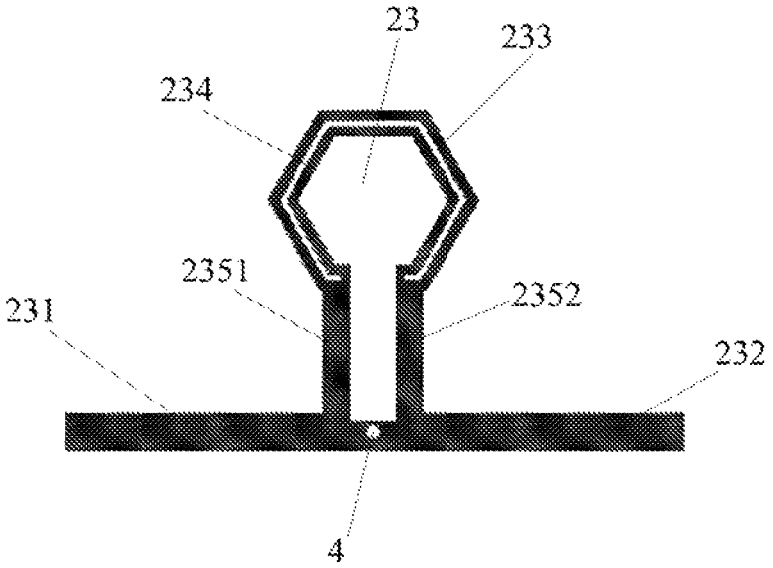
FIG. 3 is a schematic structural diagram of a band-pass filter in the microstrip line shown in FIG. 2.

As shown in FIG. 3, the first band-pass filter 23 and the second band-pass filter 23' have the same structure. Therefore, the structure of the band-pass filter is described by using the first band-pass filter 23 as an example. The first band-pass filter 23 is formed by two nested microstrips 233 and 234 that have hexagonal openings and that are connected at opening ends.

Still referring to FIG. 3, one opening end of the hexagonal openings in the first band-pass filter 23 is connected to the input end 211 of the first power division circuit 21 by using an impedance transformation segment 2351, the other opening end is connected to the input end 221 of the first low-pass filter 22 by using another impedance transformation segment 2352; and one opening end of the hexagonal openings in the second band-pass filter 23' is connected to the input end 211' of the second power division circuit 21' by using an impedance transformation segment (not shown), and the other opening end is connected to the input end 221' of the second low-pass filter 22' by using another impedance transformation segment (not shown). Passband central frequencies of the first band-pass filter 23 and the second band-pass filter 23' are both 2.6 GHz.

Figure 4:
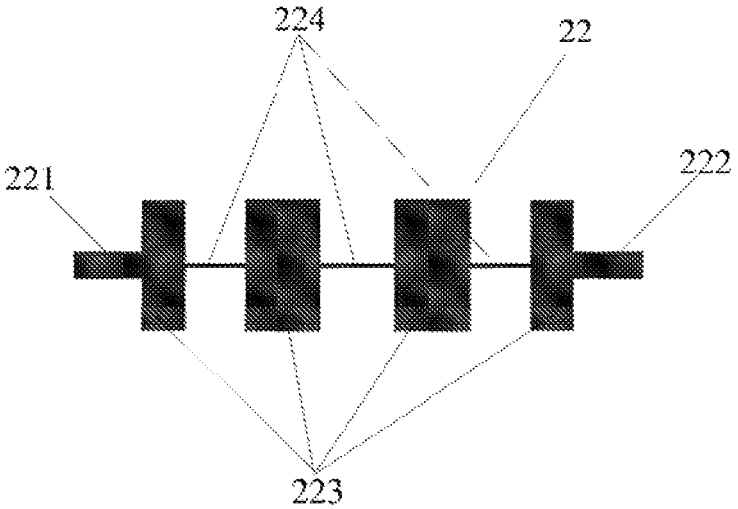
FIG. 4 is a schematic structural diagram of a low-pass filter in the microstrip line shown in FIG. 2.

Referring to FIG. 4, both the first low-pass filter 22 and the second low-pass filter 22' are stepped impedance microstrip low-pass filters. Both the first low-pass filter 22 and the second low-pass filter 22' are seventh-order stepped impedance microstrip low-pass filters. The first low-pass filter 22 and the second low-pass filter have the same structure, so that the specific structure of the low-pass filter is described by using the first low-pass filter 22 as an example. As shown in FIG. 4, the first low-pass filter 22 is formed by four low impedance lines 223 and three high impedance lines 224 that are connected in series and in a staggered manner. Cut-off frequencies of the first low-pass filter 22 and the second low-pass filter 22' are preferably 3.5 GHz.

Figure 5:
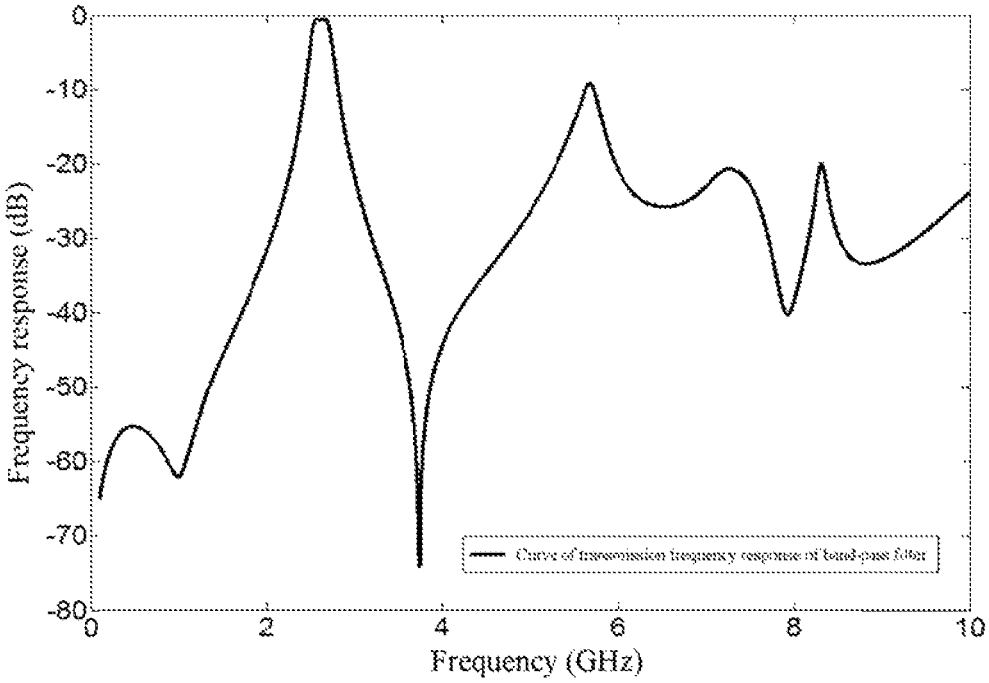
FIG. 5 is a curve diagram of transmission frequency response of the band-pass filter in the microstrip line shown in FIG. 3.
Figure 6:
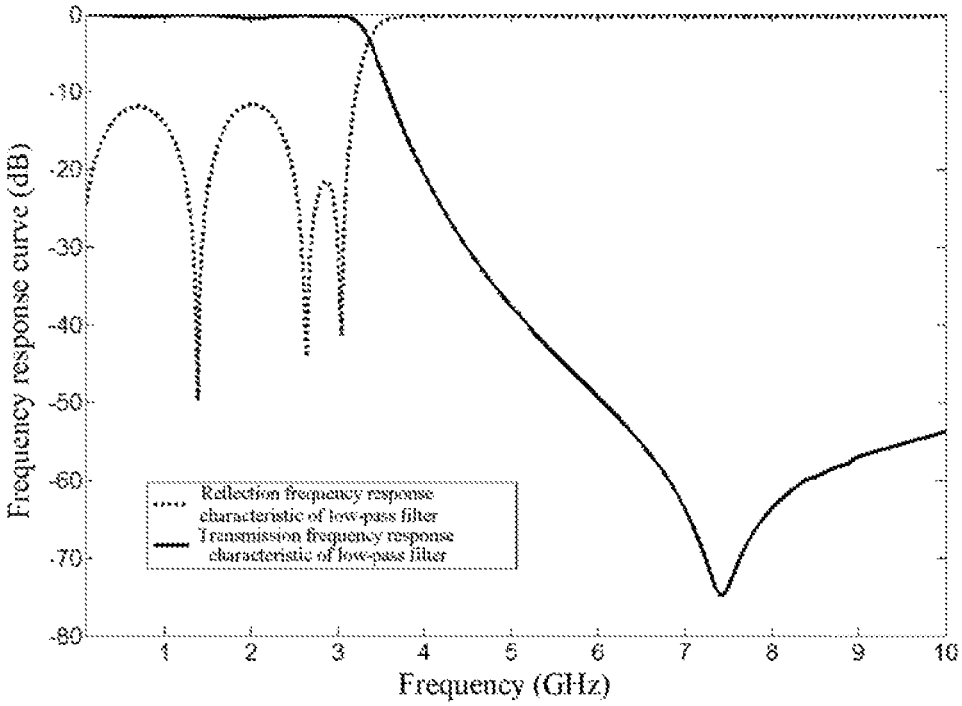
FIG. 6 is a curve diagram of transmission frequency response of the low-pass filter in the microstrip line shown in FIG. 4.
Figure 7:
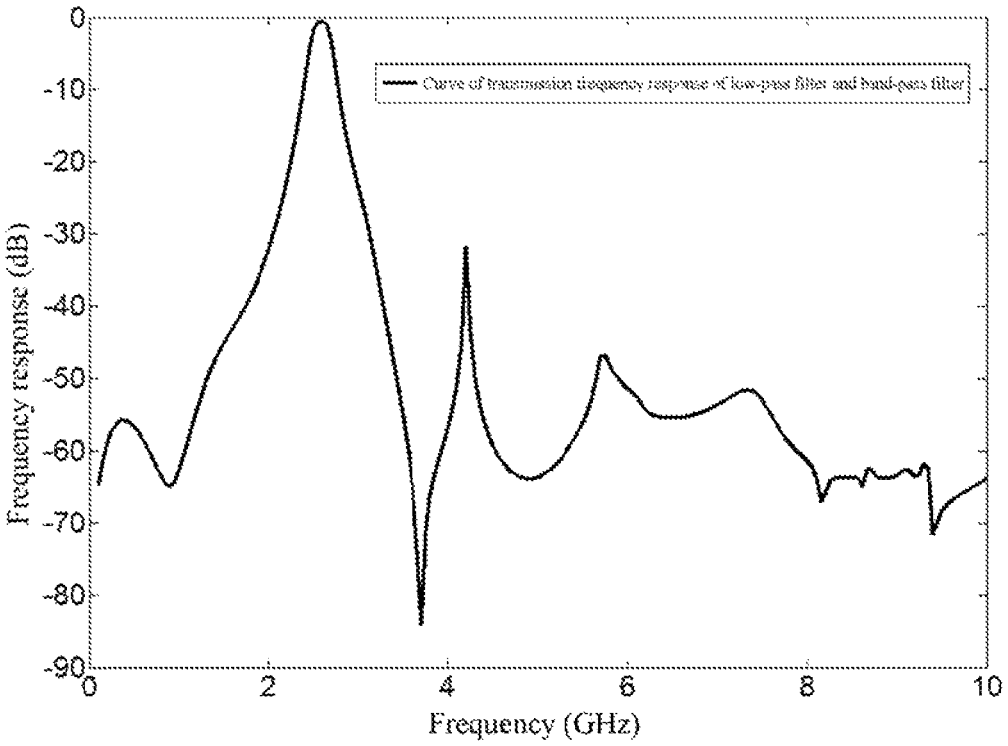
FIG. 7 is a curve diagram of transmission frequency response of a low-pass filter and a band-pass filter in the microstrip line shown in FIG. 2.

Referring to FIG. 5, FIG. 5 is a curve of transmission frequency response of the band-pass filter described above, and a passband frequency is 2.575 GHz to 2.635 GHz. Referring to FIG. 6, FIG. 6 is a curve of transmission frequency response of the low-pass filter described above, and a cut-off frequency is 3.5 GHz. Referring to FIG. 7, FIG. 7 is a curve of transmission frequency response of a low-pass filter and a band-pass filter, and a high-frequency harmonic wave in 4.0 GHz to 10 GHz is suppressed.

The filter feeding network in the present invention has the following beneficial effects.

A microstrip filter is used to replace an RRU cavity filter, and the microstrip filter is integrated with a microstrip power divider, thereby achieving a filter feeding network having a filtering function, simplifying a radio frequency unit structure, and improving system integration. The filter feeding network is highly integrated, has a small weight and a small volume, and is suitable for large-scale production.

In addition, a microstrip low-pass filter replaces a conventional metal-rod shaped low-pass filter in a cavity filter to filter a high-order harmonic wave of a band-pass filter. In addition, the microstrip low-pass filter and a microstrip band-pass filter are connected in series and are integrated with the microstrip power divider to achieve the filter feeding network having the filtering function. This can lower a requirement on outband suppression of the cavity filter, and reduce the volume and weight of the filter.

Figure 8:
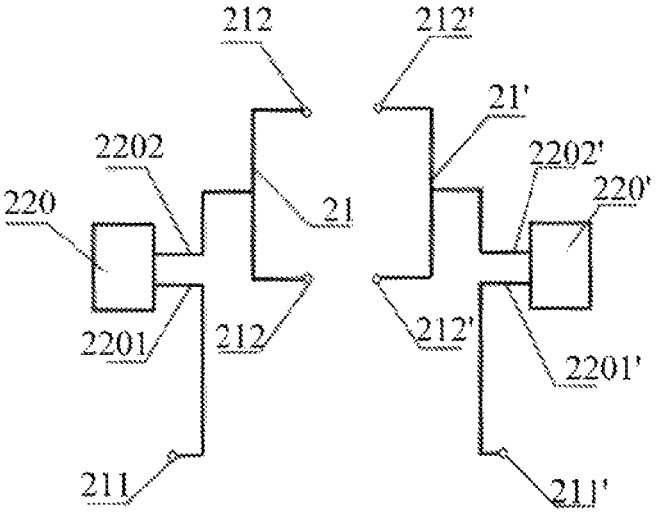
FIG. 8 is a schematic structural diagram of another embodiment of a microstrip line in the filter feeding network shown in FIG. 1.

In an embodiment, a simplified schematic diagram is shown in FIG. 8. The first filter circuit 220 may be formed by only one band-pass filter, and the second filter circuit 220' may also be formed by only one band-pass filter. The two band-pass filters have a same structure. An input end 2201 of the band-pass filter in the first filter circuit 220 is connected to the input end 211 of the first power division circuit 21 by using a microstrip, and an output end 2202 of the band-pass filter in the first filter circuit 220 is connected to the output end 212 of the first power division circuit 21 by using the microstrip. An input end 2201' of the band-pass filter in the second filter circuit 220' is connected to the input end 211' of the second power division circuit 21' by using the microstrip, and an output end 2202' of the band-pass filter in the second filter circuit 220' is connected to the output end 212' of the second power division circuit 21' by using the microstrip. In addition, band-pass filters in the first filter circuit 220 and the second filter circuit 220' may allow a wave of at least one frequency to pass. In the present invention, waves of two frequencies may be allowed to pass. Preferably, waves of frequencies of 2.54 GHz and 5.40 GHz may be allowed to pass.

Figure 9:
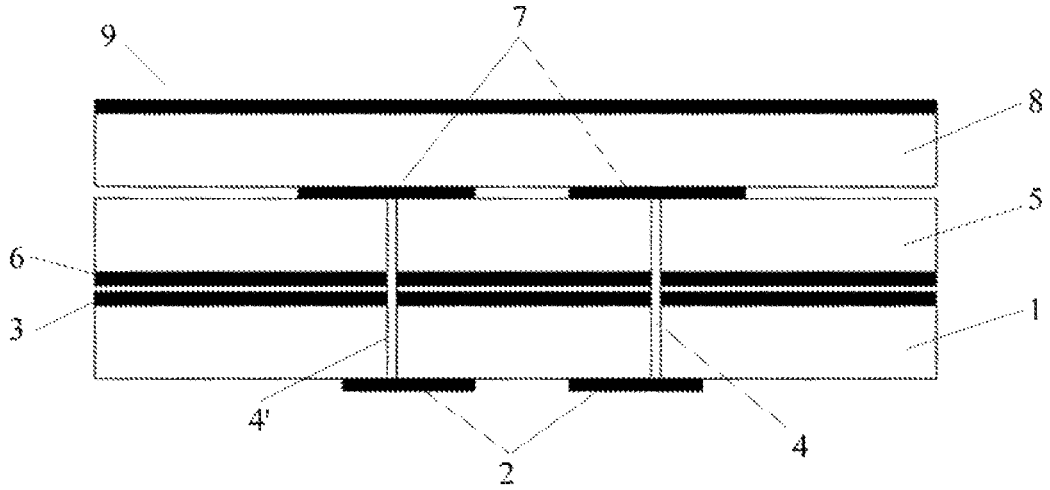
FIG. 9 is a schematic sectional structural diagram of another embodiment of a filter feeding network according to the present invention.

In another application embodiment, referring to FIG. 9, the filter feeding network in the present invention further includes a second dielectric substrate 5 and a third dielectric substrate 8. The second dielectric substrate 5 and the third dielectric substrate 8 are sequentially disposed, in a laminating manner, at the side that is of the first dielectric substrate 1 and that is provided with the metal ground 3. Further, a strip-shaped line 7 is sandwiched between the second dielectric substrate 5 and the third dielectric substrate 8.

Specifically, the metal ground 3 is disposed on the first dielectric substrate 1 to ensure composition of the microstrip line 2 and the strip-shaped line 7. Certainly, a metal ground 6 may also be disposed on a surface that is of the second dielectric substrate 5 and that is adjacent to the first dielectric substrate 1. The metal ground 3 on the first dielectric substrate 1 is connected to the metal ground 6 on the second dielectric substrate 5 by using a solidification plate (not shown). The metal ground 3 and the metal ground 6 are respectively disposed on the first dielectric substrate 1 and the second dielectric substrate 5, and this can better help improve an electrical property of the filter feeding network compared with only disposing the metal ground 3 on the first dielectric substrate 1.

Figure 10:
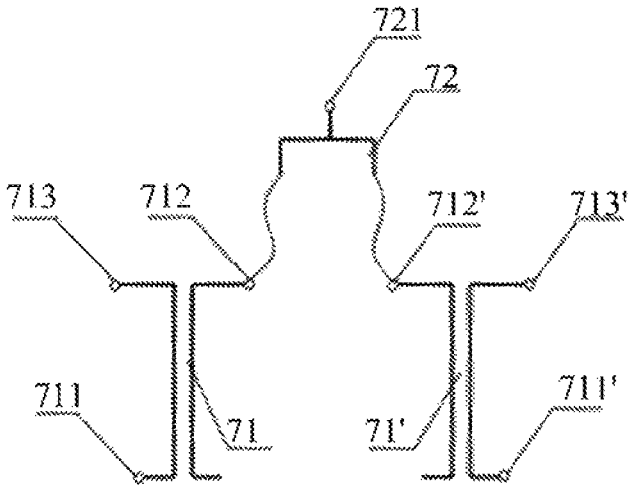
FIG. 10 is a schematic structural diagram of an embodiment of a strip line in the filter feeding network shown in FIG. 9.

As shown in FIG. 10, the strip-shaped line 7 includes a first directional coupler 71 and a second directional coupler 71' that have a same structure. An output end 711 of the first directional coupler 71 is in conduction with the input end 211 of the first power division circuit 21 by using the first metalized via 4, and an output end 711' of the second directional coupler 71' is in conduction with the input end 211' of the second power division circuit 21' by using the second metalized via 4'.

Preferably, both the first directional coupler 71 and the second directional coupler 71' are parallel coupled line directional couplers.

Further, an input end 713 of the first directional coupler 71 and an input end 713' of the second directional coupler 71' are respectively connected to a sub-miniature push-on (SMP) radio frequency connector. For example, in multiple feeding lines described below, coupling ends 712 of all the first directional couplers 71 in the feeding lines and coupling ends 712' of the second directional couplers 71' are connected by using a power combiner 72 or multiple cascaded power combiners to form a general output end 721. The general output end 721 formed by a power combiner 72 or multiple cascaded power combiners is also connected to the SMP radio frequency connector. A calibration or monitoring function may be conveniently performed by using the general output end 721.

A surface of the third dielectric substrate 8 that is distant from the second dielectric substrate 5 is provided with a metal ground 9. The metal ground 9 is disposed to replace a reflection panel in a conventional antenna, thereby reducing the quantity of parts of the antenna, and greatly reducing the volume and weight of the antenna.

In the foregoing embodiments, dielectric constants of the first dielectric substrate 1, the second dielectric substrate 5 and the third dielectric substrate 8 range from 2.2 to 10.2. The thickness of the first dielectric substrate 1 ranges from 0.254 mm to 1.016 mm, and a total thickness of the first dielectric substrate 1, the second dielectric substrate 5, and the third dielectric substrate 8 ranges from 0.76 mm to 2.70 mm. For example, RogersR04730 Da may be selected as substrate materials of the first dielectric substrate 1, the second dielectric substrate 5, and the third dielectric substrate 8. Preferably, dielectric constants of the first dielectric substrate 1, the second dielectric substrate 5, and the third dielectric substrate 8 may be 3.00, and the thickness of the first dielectric substrate 1, the second dielectric substrate 5, and the third dielectric substrate 8 may be 0.78 mm. In addition, bore diameters of the first metalized via 4 and the second metalized via 4' may be set to 1.0 mm.

During actual usage, both the quantity of the microstrip line 2 and that of the strip-shaped line 7 are set to N (N>1). A microstrip line 2 is in conduction with a strip-shaped line 7 to form a feeding line. What is shown in FIG. 1 and FIG. 9 in this specification is merely an example for description: a basic feeding line formed by only one microstrip line 2 and one strip-shaped line 7.

In combination with usage of a base station antenna such as a MIMO antenna, the output end 212 of the first power division circuit 21 and the output end 212' of the second power division circuit 21' may feed at least one array antenna unit for ±45° polarization. Specifically, the output end 212 of the first power division circuit 21 may feed at least two array antenna units for −45° polarization, and the output end 212' of the second power division circuit 21' feeds at least two array antenna units for +45° polarization. The first power division circuit 21 and the second power division circuit 21' may be each formed by a power splitter, or may be each formed by multiple cascaded power splitters.

Description is further provided by using an example. When the first power division circuit 21 and the second power division circuit 21' feed two array antenna units for ±45° polarization, both the first power division circuit 21 and the second power division circuit 21' are preferably one-to-two power splitters. When the first power division circuit 21 and the second power division circuit 21' feed three array antenna units for ±45° polarization, the first power division circuit 21 and the second power division circuit 21' may each be a one-to-three power splitter. Alternatively, a one-to-two power splitter may be cascaded with each of two output ends of a one-to-two power splitter, that is, the structure may feed four or fewer (including four) array antenna units for ±45° polarization provided that the first power division circuit 21 and the second power division circuit 21' respectively form four output ends finally. For example, when the structure feeds M (M<4) array antenna units for ±45° polarization, M output ends are randomly selected from the first power division circuit 21 to feed the M array antenna units for +45° polarization, and M output ends are randomly selected from the second power division circuit 21' to feed the M array antenna units for +45° polarization. The following may be deduced by analogy when more array antenna units need to be fed for ±45° polarization provided that multiple corresponding output ends can be formed.

The first power division circuit 21 and the second power division circuit 21' in a same feeding line may feed two or more array antenna units that are totally different or partially the same for ±45° polarization. Preferably, the first power division circuit 21 and the second power division circuit 21' in a same feeding line may feed two or more array antenna units that are totally the same for ±45° polarization, for convenience of line arrangement and control.

In addition, the present invention further provides a base station antenna, including the filter feeding network according to any of the foregoing embodiment.

The foregoing descriptions are merely implementations of the present invention, and are not intended to limit the scope of the present invention. An equivalent structural or equivalent process alternation made by using the content of the specification and accompanying drawings of the present invention, or an application of the content of the specification and accompanying drawings directly or indirectly to another related technical field, shall fall within the protection scope of the present invention.

What is claimed is:

1. A filter feeding network, comprising:

a dielectric substrate, wherein a surface of one side of the dielectric substrate is provided with a microstrip line, and a surface of the other side of the dielectric substrate is provided with a metal ground;

the microstrip line comprises first and second power division circuits, and first and second filter circuits;

an input end and an output end of the first filter circuit are respectively connected to an input end and an output end of the first power division circuit correspondingly, an input end and an output end of the second filter circuit are respectively connected to an input end and an output end of the second power division circuit correspondingly, and the input end of the first filter circuit and the input end of the second filter circuit are in conduction with the metal ground;

the first filter circuit comprises a first low-pass filter and a first band-pass filter connected in series, and the second filter circuit comprises a second low-pass filter and a second band-pass filter connected in series; and the output end of the first power division circuit feeds at least two array antenna units for −45° polarization, and the output end of the second power division circuit feeds at least two array antenna units for +45° polarization.

2. The filter feeding network according to claim 1, wherein an output end of the first band-pass filter is connected to an input end of the first low-pass filter, an input end of the first band-pass filter is connected to the input end of the first power division circuit, and an output end of the first low-pass filter is connected to the output end of the first power division circuit; and an output end of the second band-pass filter is connected to an input end of the second low-pass filter, an input end of the second band-pass filter is connected to the input end of the second power division circuit, and an output end of the second low-pass filter is connected to the output end of the second power division circuit.

3. The filter feeding network according to claim 2, wherein both the first low-pass filter and the second low-pass filter are stepped impedance microstrip low-pass filters.

4. The filter feeding network according to claim 3, wherein both the first low-pass filter and the second low-pass filter are seventh-order stepped impedance microstrip low-pass filters.

5. The filter feeding network according to claim 2, wherein the first band-pass filter and the second band-pass filter are each formed by two nested microstrips that have hexagonal openings and that are connected at opening ends.

6. The filter feeding network according to claim 5, wherein one opening end of the hexagonal openings in the first band-pass filter is connected to the input end of the first power division circuit by using an impedance transformation segment, and the other opening end is connected to the input end of the first low-pass filter by using another impedance transformation segment; and one opening end of the hexagonal openings in the second band-pass filter is connected to the input end of the second power division circuit by using an impedance transformation segment, and the other opening end is connected to the input end of the second low-pass filter by using another impedance transformation segment.

7. The filter feeding network according to claim 2, wherein cut-off frequencies of the first low-pass filter and the second low-pass filter are 3.5 GHz.

8. The filter feeding network according to claim 2, wherein passband central frequencies of the first band-pass filter and the second band-pass filter are both 2.6 GHz.

9. The filter feeding network according to claim 1, wherein a dielectric constant of the dielectric substrate ranges from 2.2 to 10.2, and the thickness of the dielectric substrate ranges from 0.254 mm to 1.016 mm.

10. The filter feeding network according to claim 1, wherein the input end of the first filter circuit is connected to the metal ground by a metalized via, and the input end of the second filter circuit is connected to the metal ground by another metalized via.

11. The filter feeding network according to claim 1, wherein the first power division circuit and the second power division circuit are each formed by a one-to-two power splitter; or the first power division circuit and the second power division circuit are each formed by multiple cascaded power splitters.

12. A base station antenna, comprising the filter feeding network according to claim 1.

13. The base station antenna according to claim 12, wherein the base station antenna is a base station antenna using a MIMO system.

* * * * *